US006743031B2

(12) United States Patent
Baumgaertner et al.

(10) Patent No.: US 6,743,031 B2
(45) Date of Patent: Jun. 1, 2004

(54) PLUG CONNECTOR WITH A SWITCH

(75) Inventors: Roland Baumgaertner, Bonndorf (DE); Volker Rombach, Furtwangen (DE); Frank Roese, Hamburg (DE)

(73) Assignee: IMS Connector Systems GmbH, Loeffingen (DE)

( * ) Notice: Subject to any disclaimer, the term of this patent is extended or adjusted under 35 U.S.C. 154(b) by 0 days.

(21) Appl. No.: 09/982,539

(22) Filed: Oct. 18, 2001

(65) Prior Publication Data

US 2002/0090863 A1 Jul. 11, 2002

(30) Foreign Application Priority Data

Oct. 18, 2000 (DE) ..... 100 51 791

(51) Int. Cl.[7] ..... H01R 29/00

(52) U.S. Cl. ..... 439/188; 200/51.09; 200/533; 200/51.1

(58) Field of Search ..... 439/188; 200/51.09, 200/533, 51.1

(56) References Cited

U.S. PATENT DOCUMENTS 4,165,147 A 8/1979 Buck
4,633,048 A 12/1986 Komatsu ..... 200/51
5,741,146 A 4/1998 Henry et al. ..... 439/188
6,152,750 A 11/2000 Huguenet et al. ..... 439/188
6,319,030 B1 * 11/2001 Wu ..... 439/188

FOREIGN PATENT DOCUMENTS

DE 642 832 C 3/1937
DE 00 05 861 B1 12/1981
DE 28 06 075 C2 5/1987

* cited by examiner

*Primary Examiner*—Javaid H. Nasri
(74) *Attorney, Agent, or Firm*—Gauthier & Connors LLP

(57) ABSTRACT

A plug connector has a U-shaped snap-on clip with a web, which incorporates a contact lug. The web is seated in a slot of the casing. A contact is situated at the end of the U-shaped snap-on clip, between its arms. An opening for inserting a contact pin is situated in the top side of the housing. This contact pin spreads the arms of the U-shaped snap-on clip, so that they detach from the contact. This plug connector, which is especially suited for use in a cordless radiotelephone, is distinguished by a small structural size, low production costs, a small number of components, high contact reliability, and an especially low juncture resistance.

13 Claims, 2 Drawing Sheets

PLUG CONNECTOR WITH A SWITCH

BACKGROUND OF THE INVENTION

The invention relates to a plug connector with a switch. Plug connectors with switches are used for example in cordless telephones and consequently should be as small as possible, but nevertheless should be relatively inexpensive to produce.

An object of the invention to design a plug connector with a switch that as relatively small and inexpensive to produce.

SUMMARY OF THE INVENTION

Briefly, according to an aspect of the invention, a plug connector with a switch includes a web of a U-shaped snap-on clip, with a first contact, is disposed in a casing, and a second contact is situated between the arms of the U-shaped snap-on clip. A contact pin can be placed between the arms of the U-shaped snap-on clip, such that the arms of the U-shaped snap-on clip are separated from the second contact when the contact pin is inserted.

The U-shaped snap-on clip comprises two equal arms and a web connecting these and at right angles to them. The first contact is incorporated into this web, for example, as a contact lug. The U-shaped snap-on clip with the contact lug preferably is made of one piece.

In a first embodiment, the second contact is situated at the end of the U-shaped snap-on clip, between its arms. Alternatively, the second contact can also be placed between the arms from the top or from the bottom.

The web of the U-shaped snap-on clip preferably is placed into a slot of the casing.

The casing of the plug connector is made for example of a nonconducting material. It is at least partially covered with a metal coating for shielding purposes.

The contact pin is placed between the arms of the U-shaped snap-on clip either from the top or from the bottom.

In a second embodiment of the invention, the contact pin is placed between the arms of the U-shaped snap-on clip from the rear, against the front side of the web.

The inventive plug connector has the following advantages: First, the U-shaped snap-on clip is loaded symmetrically. This leads to a second advantage, namely that the fastening of the U-shaped snap-on clip is not subject to stress. A third advantage is that two contact surfaces are available both for the second contact and for the contact pin, one surface at one arm and the other at other arm of the U-shaped snap-on clip. This increases the reliability of contact and at the same time achieves an especially low juncture resistance.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
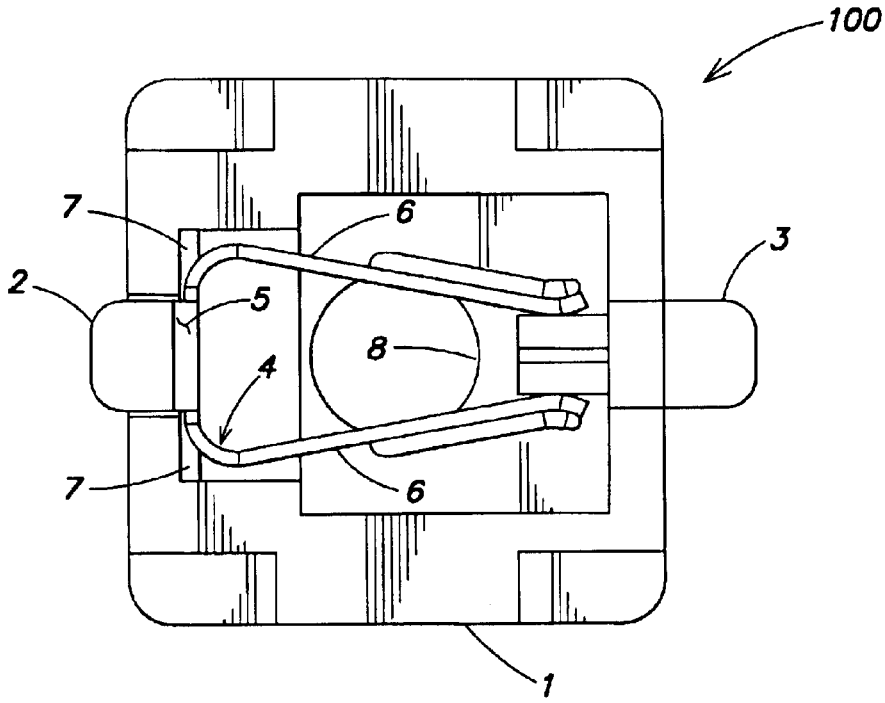
FIG. 1 shows an embodiment of the inventive plug connector from below.

FIG. 1 illustrates a bottom view of a plug connector 100. The plug connector 100 includes an electrically non-conducting casing 1 (e.g., plastic). A web 5 of a u-shaped snap-on clip 4 having two arms 6, is seated in a slot 7 of the casing 1. A contact lug 2, which forms a first contact, is situated on the web 5. A second contact 3 is placed at the end of the u-shaped snap-on clip 4, between the snap-on clip arms 6. However, this contact is not constructed as a separate part but is incorporated into the casing 1. To create an electrical contact, the second contact 3 is covered with a metal coating. An opening 8 to insert a contact pin is situated on the top side of casing 1. The contact pin is placed between the two arms 6 of the U-shaped snap-on clip 4, so as to spread the two arms 6 and isolate them from the second contact 3. The contact pin is now electrically connected, via the U-shaped snap-on clip 4, to the first contact 2, which is constructed as a contact lug.

Figure 2:
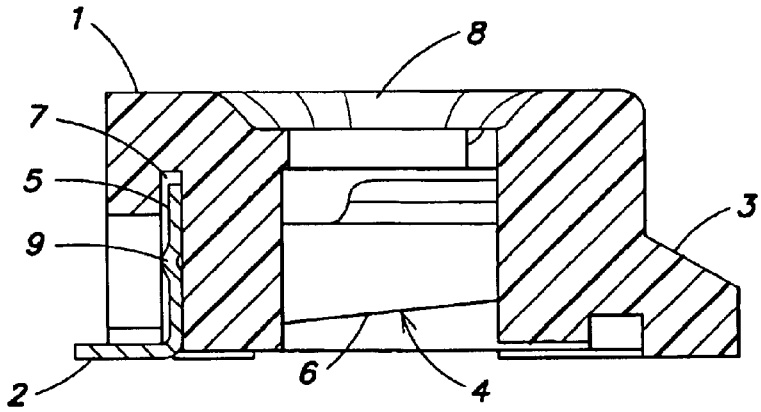
FIG. 2 shows a longitudinal section through the embodiment.

FIG. 2 shows a longitudinal section through the embodiment illustrated in FIG. 1. A bead 9 is incorporated into the web 5, to secure the U-shaped snap-on clip 4 in the slot 7.

Figure 3:
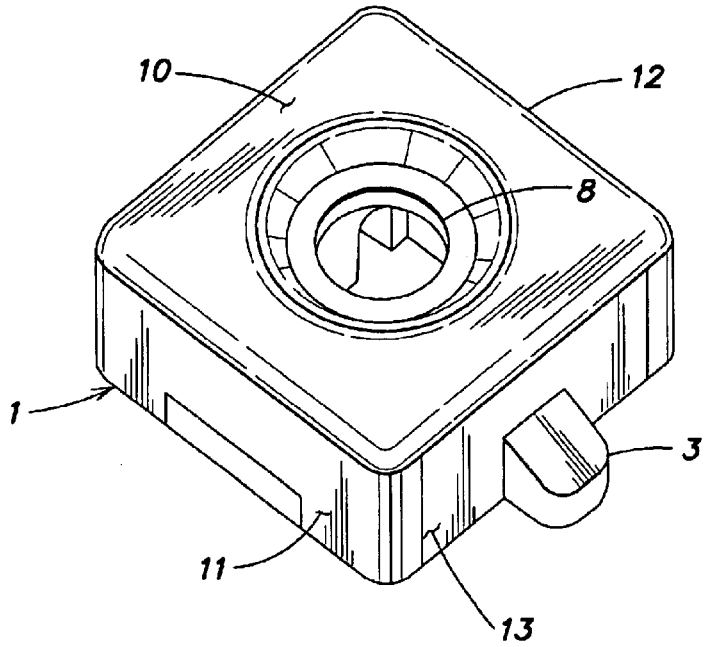
FIG. 3 shows the casing of the embodiment, from the top, in perspective.

FIG. 3 shows the housing, viewed from the top, in perspective. The opening 8 for the contact pin is incorporated into the top side of the housing 1. The second contact 3, whose surface is covered with a metal coating, partly protrudes from the front side of the housing 1.

Figure 4:
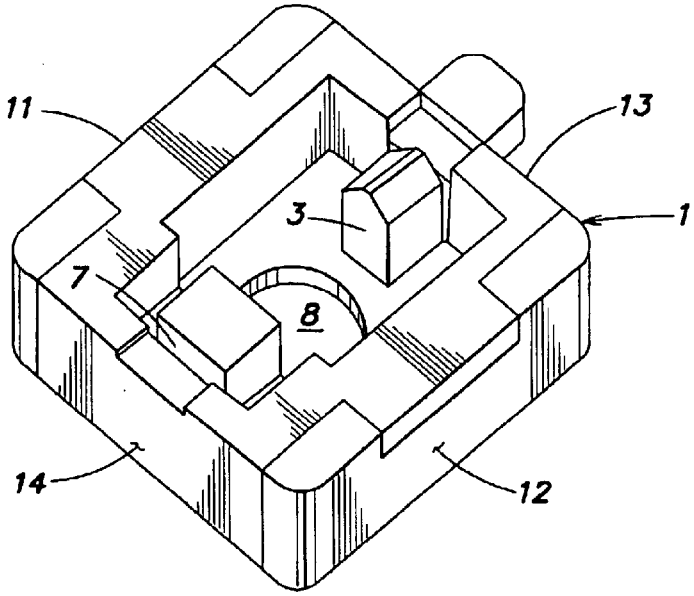
FIG. 4 shows the casing of the embodiment from below, in perspective.

FIG. 4 is a bottom perspective view of the plug connector 100. The snap-on clip 4 is not shown in this view for ease of illustration. The second contact 3, covered with a metal coating, is incorporated into a front side 13 of the housing 1. The slot 7, for inserting the web 5 of the U-shaped snap-on clip 4, is situated on the back side 14 of the housing 1. The opening 8 for the contact pin can be seen in the top side 10 of the housing 1.

The top side 10 as well as the right side 11 and the left side 12 of the housing 1 are covered with a metal coating, so as to form a chassis ground, which can be connected to an earth ground. The u-shaped snap-on clip can be made for example of metal or of a plastic that is covered with a metal coating.

Because the U-shaped snap-on clip is loaded symmetrically, its attachment point remains unstressed. Because the U-shaped snap-on clip extends horizontally, the structural height of the device can be kept small. The integral casing of plastic, with a metal coating in certain places, performs the functions of HF-shielding, stationary contact, and insulation.

the first contact and the insertable contact pin may be disposed collinear with the longitudinal axis of the U-shaped snap-on clip, and the second contact is inserted perpendicular to this, between the arms of the U-shaped snap-on clip. In addition, the first contact and the U-shaped snap-on clip may be produced in one piece.

in summary, the inventive plug connector is distinguished by a small structural height, low production costs, a small number of components, high contact reliability, and an especially low juncture resistance.

Although the present invention has been shown and described with respect to several preferred embodiments thereof, various changes, omissions and additions to the form and detail thereof, may be therein, without departing from the spirit and scope of the invention.

What is claimed is:

1. A plug connector with a switch, comprising a web of a U-shaped snap-on clip, with a first contact, is disposed in a casing, and a second contact is situated between arms of the U-shaped snap-on clip, and a contact pin can be placed between the arms of the U-shaped snap-on clip, such that the arms of the U-shaped snap-on clip are separated from the second contact when the contact pin is inserted.

2. The plug connector of claim 1, characterized in that the first and the second contacts are disposed collinear with the longitudinal axis of the U-shaped snap-on clip, and the contact pin can be placed perpendicular to the longitudinal axis, between the arms of the U-shaped snap-on clip.

3. The plug connector of claim 1, characterized in that the first contact and the insertable contact pin are disposed collinear with the longitudinal axis of the U-shaped snap-on clip, and that the second contact is inserted perpendicular to this, between the arms of the U-shaped snap-on clip.

4. The plug connector of claim 2, characterized in that the casing is made of an electrically insulating material.

5. The plug connector of claim 4, characterized in that the second contact is designed as a contact that is incorporated into the casing, and the second contact includes a surface that is covered with a metal coating.

6. The plug connector of claim 5, characterized in that the web of the U-shaped snap-on clip is seated in a slot of the casing.

7. The plug connector of claim 6, characterized in that the first contact is designed as a contact lug on the web of the U-shaped snap-on clip.

8. The plug connector of claim 7, characterized in that a bead is incorporated into the web of the U-shaped snap-on clip.

9. The plug connector of claim 8, characterized in that the U-shaped snap-on clip comprises plastic that is covered with a metal coating.

10. The plug connector of claim 9, characterized in that the U-shaped snap-on clip comprises metal.

11. The plug connector of claim 10, characterized in that the first contact and the U-shaped snap-on clip are produced in one piece.

12. The plug connector of claim 11, characterized in that the casing is at least partially covered with a metal coating for shielding.

13. The plug connector of claim 11, characterized in that a top side as well as right and left sides of the casing are covered with a metal coating for connection to ground.

* * * * *

UNITED STATES PATENT AND TRADEMARK OFFICE

CERTIFICATE OF CORRECTION

PATENT NO. : 6,743,031 B2
DATED : June 1, 2004
INVENTOR(S) : Baumgaertner et al.

It is certified that error appears in the above-identified patent and that said Letters Patent is hereby corrected as shown below:

Column 1,
Line 44, replace “the following” with -- a number of --
Line 45, replace “:” with -- . --
Line 46, after “advantage”, delete “, namely”

Column 2,
Lines 6, 10 and 41, delete “u-shaped” and insert -- U-shaped --
Line 15, after “top side of” insert -- the --
Line 50, before “first contact” replace “the” with -- The --
Line 56, before “summary” replace “in” with -- In --
Line 63, after “may be” insert -- made --

Column 3,
Line 1, before “a second contact” insert -- that --
Line 2, before “a contact pin” insert -- that --

Signed and Sealed this

Seventh Day of September, 2004

JON W. DUDAS
*Director of the United States Patent and Trademark Office*